US005234199A

United States Patent [19]

Cluff

[11] Patent Number: 5,234,199

[45] Date of Patent: Aug. 10, 1993

[54] CHAIN LINK FENCING WITH DECORATIVE SLATS

[76] Inventor: Robert G. Cluff, 4983 Cahoon Cir., Taylorsville, Utah 84118

[21] Appl. No.: 364,825

[22] Filed: Jun. 9, 1989

Related U.S. Application Data

[63] Continuation-in-part of Ser. No. 237,386, Aug. 29, 1988, abandoned.

[51] Int. Cl.[5] ..... B21F 27/00

[52] U.S. Cl. ..... 256/34; 256/35; 256/22; 245/11

[58] Field of Search ..... 256/34, 35, 22; 52/731; 245/11

[56] References Cited

U.S. PATENT DOCUMENTS

| | | | |
|---|---|---|---|
| 3,420,504 | 1/1969 | Mulitz | 52/731 X |
| 3,452,501 | 7/1969 | Zimmer | 52/823 X |
| 3,485,006 | 12/1969 | De Rozario | 256/65 X |
| 3,712,590 | 1/1973 | Tochner | 256/12.5 X |
| 4,085,954 | 4/1978 | Thompson | 256/34 |
| 4,570,906 | 2/1986 | Walden | 256/35 X |
| 4,995,591 | 2/1991 | Humphrey et al. | 256/34 |

*Primary Examiner*—Randolph A. Reese
*Assistant Examiner*—Anthony Knight
*Attorney, Agent, or Firm*—Terry M. Crellin

[57] ABSTRACT

In a chain link fence having a plurality of elongate slats woven through the links of the chain link fabric, an improved system for retaining and locking the slats in the chain link fabric comprises (1) an elongate rail woven between consecutive links of the chain link fence such that the rail lies adjacent to mutually respective, aligned, first ends of the elongate slats, and (2) engagement members formed integrally with the mutually respective first ends of the elongate slats, with the engagement members including interlocking means which make interlocking engagement with the elongate rail when the respective first end of the elongate slat is abutted against the elongate rail.

18 Claims, 4 Drawing Sheets

CHAIN LINK FENCING WITH DECORATIVE SLATS

BACKGROUND OF THE INVENTION

This is a continuation-in-part application of my copending application Ser. No. 07/237,386, filed Aug. 29, 1988 and now abandoned.

FIELD OF THE INVENTION

The present invention relates to chain link fences which have a plurality of decorative, elongate slats woven through the links of the chain link fabric of the fence. More particularly, the present invention relates to improved means for locking and retaining the slats in a uniform position along the fencing. Further, the present invention relates to an improved rail element and corresponding slats having engagement members formed integrally at mutually respective ends thereof, with the engagement members comprising means for interlocking engagement with the rail when the respective ends of the slats abut against the rail.

State of the Art

It is well known to insert slats in chain link fences to provide privacy and to improve the appearance of the fence. Unfortunately, there are two somewhat related, serious problems encountered in using slats in chain link fencing. First, the slats have a tendency to shift longitudinally after being inserted in the wire fabric of the chain link fence so as to become disarranged and uneven. Disarranged, uneven slats greatly impair the appearance of the fence. The second related problem is that the loosely positioned slats are easy prey for vandals. The slats are, unfortunately, easily removed from the fence by vandals.

Several methods have been proposed to alleviate these problems. The slats have been secured to the chain links in the fence by using staples, nails and other fasteners. In addition, systems have been proposed for interlocking the slats with channel members or elongate rigid connecting members which run along the length of the fence and which engage the slat members. The installation of such systems is a tedious, time consuming, costly operation. Prior to two U.S. patents which have been recently issued to me, no inexpensive, expedient means had been proposed to effectively cope with the vandalism problem. Some of the prior patent literature suggest complex systems which to some degree alleviates the vandalism problem, but as stated previously, these systems are unfortunately rather costly and require tedious, time consuming installation. Representative U.S. Pat. Nos. which have been directed to retaining slats in position in chain link fences are:

| | | |
|---|---|---|
| 2,760,759 | 3,037,593 | 4,085,954 |
| 2,802,645 | 3,069,142 | 4,512,556 |

In two of my own previous patents, namely U.S. Pat. Nos. 4,723,761 and 4,725,044, I have disclosed novel means of retaining slats within the chain link fabric using clip members which engage the slats and prevent the slats from moving within the chain link fencing. In U.S. Pat. No. 4,725,044, a system is disclosed in which the clip members interconnect a respective end of a slat to a rail positioned adjacent to the end of the slat. Although the system using the clip to interconnect the slat to the rail has been commercially acceptable, it would be highly desirable to develop a system in which the ends of the slats interconnect directly with a rail positioned adjacent to the ends of the slat without requiring a separate clip member for interconnecting the slats with the rail.

Objective

A principal objective of the present invention is to provide a new and improved rail and slat system in which engagement means are formed integrally on mutually respective ends of the slats, and a locking rail is positioned along the mutually respective ends of the slats, wherein the engagement means of the slats makes interlocking engagement with the rail so as to retain the slats at a uniform position along the fencing and locking the slats into the fence to thwart vandalism.

SUMMARY OF THE INVENTION

The above objective is achieved in accordance with the present invention by providing a chain link fence of the type including a plurality of elongate slats woven flatwise through the links of the chain link fabric of the fence in spaced, parallel arrangement. The slats, although not essential, preferably have a hollow, flattened, tubular shape whereby the slats comprise a pair of generally flat, spaced apart sides facing each other, with the two sides being joined along mutually respective lateral edges by curved edge walls which together with the sidewalls form a substantially enclosed, elongate space within the slat. The enclosed space defined by the walls of the slat is generally open only at the ends of the elongate slat.

The present invention provides an improvement in means for retaining and locking the slats within the fencing, wherein a longitudinal rail is woven between consecutive links of the chain link fence, with the rail lying adjacent to mutually respective, aligned ends of the elongate slats. Engagement members are formed integrally with the mutually respective ends of the elongate slats, with the engagement members including interlocking means which make interlocking engagement with the elongate rail when the respective ends of the elongate slats are abutted against the rail.

Because the elongate rail is woven into the fencing substantially perpendicular to the elongate dimensions of the slats, the rail is bound by the links of the chain link fencing from movement in a direction along the elongate dimensions of the slats. Thus, when the slats interlock with the rail, they are prevented from movement along their longitudinal dimension. It thus becomes very difficult for a vandal to dislodge the slat from the fence. In addition, the ends of the slats are uniformly positioned along the rail so as to improve the visual appearance of the fencing.

Additional objects and features of the present invention will become apparent from the following detailed description, taken together with the accompanying drawings.

DRAWINGS

Preferred embodiments of the present invention representing the best modes presently contemplated of carrying out the invention are illustrated in the accompanying drawings, in which.

DETAILED DESCRIPTIONS OF THE PREFERRED EMBODIMENTS

Figure 1:
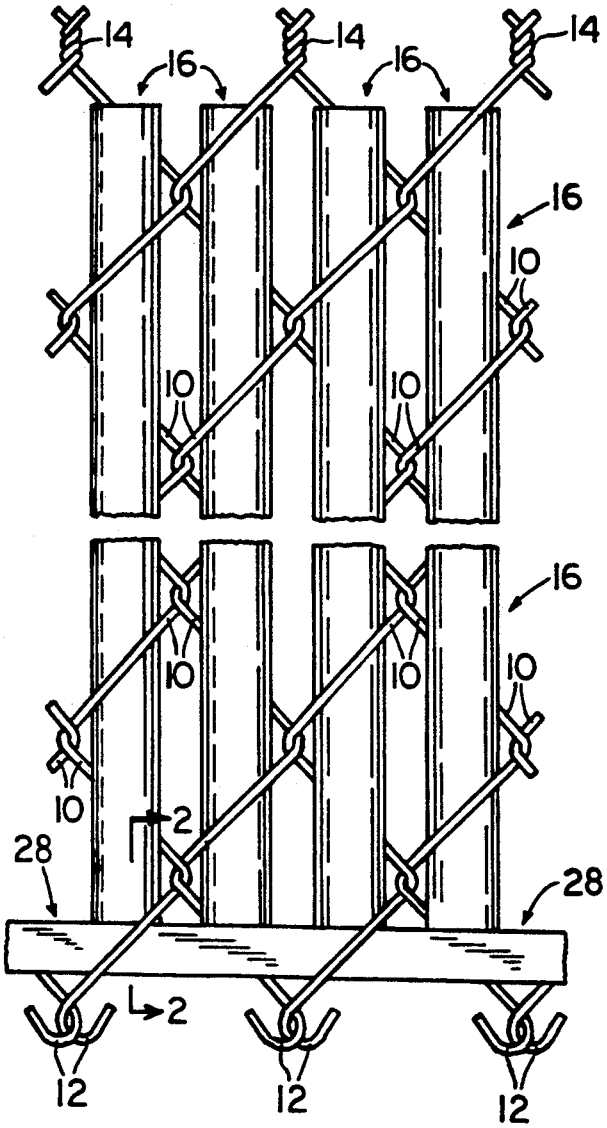
FIG. 1 is a fragmentary view in elevation of a portion of chain link fencing in accordance with the present invention.

Several preferred embodiments of the chain link fencing system of the present invention are shown in the drawings and will be described hereinafter. Like parts in the various figures of the drawings will be identified with the same reference numbers.

The present invention involves an improvement in conventional chain link fencing in which elongate wires are bent in zig-zag manner and interlocked on with another to form a chain link fabric comprising a plurality of links 10. The bottom ends of adjacent wires of the chain link fabric may be interconnected by reversely bent end portions 12, and the upper ends of adjacent wires are interconnected by twisting the upper portions together The twisted upper portions 14 present rather sharp barbs which discourage attempts to climb over the fence. It is the preference of some, however, to invert the chain link fabric so as to place the twisted end portions 14 at the bottom.

A plurality of elongate slats 16 are disposed in spaced, parallel relationship In the illustrated embodiments, the slats 16 are woven through the chain links 10 so as to extend vertically relative to the fence. However, it should be recognized that the slats 16 could just as well be woven through the chain links 10 so as to extend horizontally relative to the fence. In accordance with the present invention, a combination of novel slats and cooperating rail are provided for retaining the slats in uniform positions along the fencing as well as physically locking the slats in the chain link fencing such that the slats cannot be readily removed or otherwise subject to vandalism.

Figure 14:
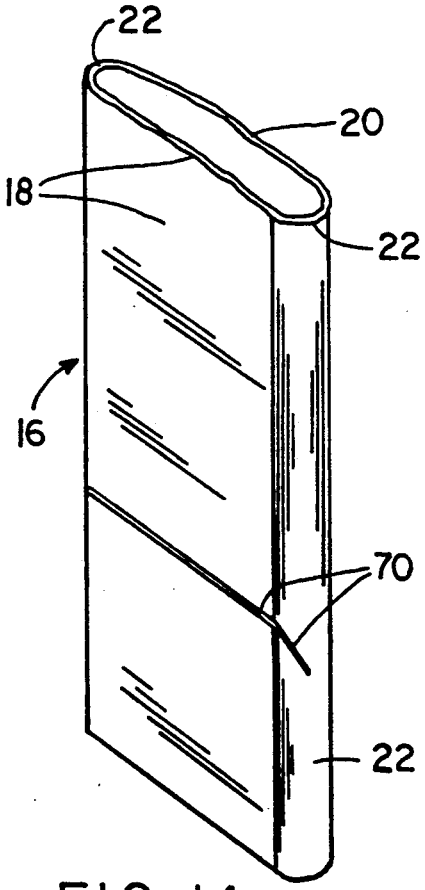
FIG. 14 is a fragmentary pictorial view of the end of the slat of FIGS. 12 and 13.
Figure 5:
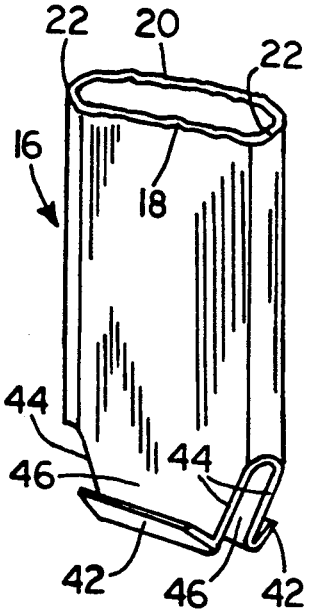
FIG. 5 is a fragmentary pictorial view of the end of the slat of FIG. 4 showing an second preferred embodiment of engagement means for engaging the corresponding rail.
Figure 3:
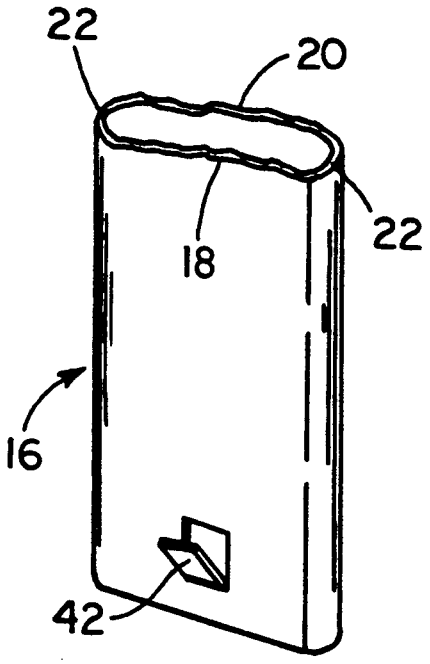
FIG. 3 is a fragmentary pictorial view of the end of the slat of FIG. 2 showing one preferred embodiment of engagement means for engaging the corresponding rail.

Preferably, the slats 16 are made of a plastic material and are formed so as to have a flattened, tubular shape as best illustrated in FIGS. 3, 5 and 14. Such slats 16 have essentially flat front and back sides or faces 18 and 20, respectively, which are spaced apart, with the sides or faces 20 being substantially parallel to each other and in longitudinal alignment with each other. The sides 18 and 20 are joined along mutually respective lateral edges by curved end walls 22 to complete the elongate, tubular shape. An elongate space is enclosed within the tubular slats 16, with the space being generally open only at the ends of the slats 16.

In accordance with the present invention, an improvement is provided in the means for retaining the slats 16 at uniform positions and for securely locking the slats in the chain link fabric so as to prevent the slats 16 from being removed from the fencing by vandals. As shown in the drawings, an elongate rail 28 is woven between consecutive links 10 of the chain link fence such that the rail 28 lies adjacent to mutually respective, aligned, first ends of the elongate slats 16 which are woven in the links 10 of the chain link fence substantially perpendicular to the rail 28.

Engagement members are formed integrally with the mutually respective first ends of the elongate slats 16 with the engagement members including interlocking means which make interlocking engagement with the elongate rail 28 when the respective first end of the elongate slat 16 is abutted against the elongate rail 28. The rail 28 preferably has at least one elongate, engageable edge extending longitudinally therealong, and the interlocking means of the engagement members on the slats 16 make interlocking engagement with the engageable edge of the elongate rail 28.

As illustrated in the drawings, the elongate rail 28 preferably has the shape of a trough in which two legs 30 extend from a base 32, with the free ends of the legs 30 lying adjacent each other in spaced position to form an elongate narrow opening 34 between the free ends of the legs 30. An elongate lip 36 extends inwardly from the free end of at least one of the legs 30 toward the central portion of the elongate rail 28, such that the lip 36 forms an elongate, engageable edge extending longitudinally along the rail 28. Preferably, a lip 36 extends from the free end of each of the legs 30 as illustrated in FIGS. 2, 4, 9, and 11. The engageable edge of the rails 28 shown in FIGS. 6 and 7 will be described in more detail hereinafter.

Figure 2:
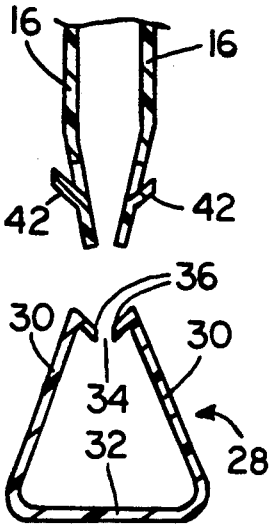
FIG. 2 is an exploded cross section of the rail and mutually corresponding end of a slat as taken along line 2—2 of FIG. 1.

The rail 28 can have several advantageous cross-sectional shapes as shown in the drawings. In FIG. 2, the base 32 has a substantial width, and the legs 30 slope inwardly toward each other. As shown in FIGS. 4, 9, 11–13, 16 and 17, the base 32 is rather narrow, and the legs 30 slope outwardly away from each other. In the embodiment shown in FIGS. 6 and 7, the base has a significant width, and the legs 30 slope inwardly to a point, with the cross-sectional shape of the rail 28 being generally triangular.

The engagement members on the ends of the slats 16 are preferably formed from at least one integral barb 42 formed at each of the mutually respective ends of the elongate slats 16 as shown in FIGS. 2–5, 8, 9, and 11, or as a planar slit 70 cut in the side of the slat 16 as shown in FIGS. 12–15. When a mutually respective end of a slat 16 is inserted in the narrow opening between the free ends of the legs 30 of the corresponding elongate rail 28, the barb 42 or the slit 70 interlocks and engages with the lip 36 to retain the end of the slat 16 within the narrow opening in the elongate rail 28 as shown in FIGS. 9, 11, 12 and 13.

As illustrated in FIG. 5, the opposite end corners of the mutually respective ends of the slats 16 have notches 44 cut in the lateral side surface of the slats 16 such that each of the mutually respective ends of the slats 16 comprises a pair of substantially planar, resilient, spaced flange members 46. At least one of the spaced flange members 46 has a barb 42 extending outwardly from the corresponding flange member 46. Preferably, each of the flange members 46 have a barb 42 extending therefrom. In the embodiment illustrated in FIG. 5, the barb 42 is advantageously formed on the flange member 46 by an elongate ledge extending outwardly of the free end of the flange member 46 in a direction away from the free end of the flange member 46. The spaced flange members 46 of mutually respective ends of the slats 16 are adapted to be inserted into the elongate narrow opening 34 of the elongate rail 28, with the barbs 42 on the respective flange members 46 making interlocking engagement with the elongate lip 36 of the elongate rail 28.

As shown in FIG. 3, the barb 42 can be formed at each of the ends of the respective elongate slats 16 by punching a flat projection from at least one flat side of the respective slat 16 adjacent to the end thereof, with the projection slanting outwardly of the slat 16 in a direction away from the end of the slat 16. Preferably, each of the flat sides of the slats 16 has a projection punched therefrom.

Figure 8:
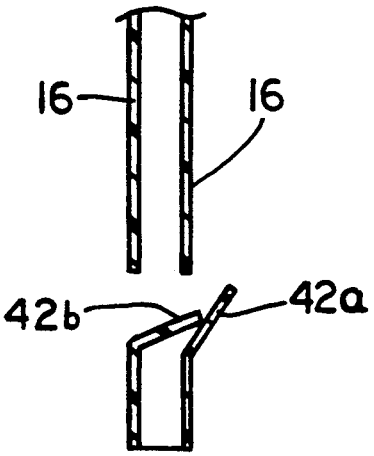
FIG. 8 is a cross section through the end of a slat similar to the end of the slat shown in FIG. 3 but showing a modified embodiment of the engagement means for engaging the corresponding rail.

FIG. 8, a first barb **42*a* is formed at each of the mutually respective ends of the elongate slats 16 by punching a flat, first projection from one flat side of the slat 16 adjacent to the end of the slat 16, with the first projection slanting outwardly of the slat 16 in a direction away from the end of the slat 16. A second barb 42*b* is formed at each of the mutually respective ends of the elongate slats 16 by punching a flat, second projection from the flat side of the slat 16 opposite the flat side from which the first projection is punched, with the second projection slanting in the same direction as the first projection such that the outer end of the second projection extends across the width of the slat 16 and lies adjacent to the first projection Advantageously, the second projection is slightly larger in width than the first projection, such that the second projection is forced into an opening formed in the slat 16** by the punching of the first projection, whereby the outer end of the second projection is bound in position lying adjacent to the first projection.

A principle reason for slanting the second projection into the opening of the first projection and against the first projection is to maintain an obstruction which will not allow the first projection to migrate back into position in the side of the slat. When the slats are bundled together for shipping, there are external forces which tent to push the first projection back into the opening from which it was displaced. Binding the second projection in the opening of the first projection and against the first projection overcomes the tendency of the first projections to migrate back to the side of the slat from whence they were punched.

The opposite end corners of the mutually respective ends of the slats 16 illustrated in FIG. 3 could have notches cut in the lateral side surface of the slats 16 in a manner similar to that shown in FIG. 5 such that each of the mutually respective ends of the slats 16 would comprise a pair of substantially planar, resilient, spaced flange members similar to the flange members 46 of FIG. 5. At least one of the spaced flange members would have a barb 42 extending outwardly from the flange member, with the barb 42 being formed by punching a flat projection from the flange member. The projection would slant outwardly of the flange member and in a direction away from the respective end of the slat 16. Preferably, each of the flange members would have a barb 42 extending therefrom.

As mentioned previously, FIGS. 6 and 7 of the drawings show modified embodiments wherein the rail 28 has a substantially triangular cross-sectional shape. Two legs 30 of the triangular, cross-sectional shape extend from the opposite sides of the third leg or base 32 of the triangular, cross-sectional shape to meet in an integral point which faces the mutually respective slats 16. The intersection of the two legs 30 and the third leg 32 form elongate, engageable edges extending longitudinally along the rail.

Figure 6:
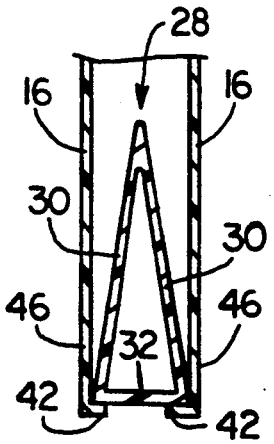
FIG. 6 is a cross section similar to one taken along line 2—2 of FIG. 1 but showing a third preferred embodiment of the rail and slat in accordance with the invention.

To engage with such a rail as shown in FIG. 6, the opposite end corners of the mutually respective ends of the slats 16 have notches cut in the lateral side surface of the slats 16. The notches are not shown in the cross-sectional view of FIG. 6, but are similar to the notches 44 of the slat 16 shown in FIG. 5. Also similar to the slat 16 of FIG. 5, the end of the slat 16 of FIG. 6 comprises a pair of substantially planar, resilient, spaced flange members 46 which are shown in FIG. 6 at the bottom end of the slat 16. The flange members 46 are similar to the flange members 46 of the slat 16 shown in FIG. 5.

The engagement members on the slat 16 of FIG. 6 are formed by an integral barbs 42 extending inwardly of the slat 16 from at least one of said spaced flange members 46. As shown in FIG. 6 barbs 42 preferably extend inwardly from both sides of the slat 16, i.e., from both of the flange members 46 at the bottom of the slat 16. The spaced flange members 46 of mutually respective slats 16 are adapted to be inserted over said elongate rail 28, with the barbs 42 on the respective flange members 46 making interlocking engagement with the elongate engageable edges of the elongate rail 28 as shown in FIG. 6.

Figure 7:
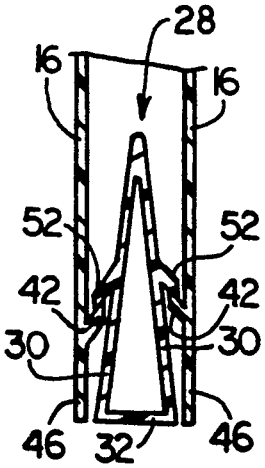
FIG. 7 is a cross section similar to that of FIG. 6 but showing a fourth preferred embodiment of the rail and slat in accordance with the invention.

In FIG. 7 there is shown an elongate rail 28 which has a substantially triangular cross-sectional shape similar to the rail 28 of FIG. 6. In the embodiment shown in FIG. 7, an elongate fin 52 projects outwardly from at least one of the two legs 30 of the triangular, cross-sectional shape of the rail 28 to form an engageable edge extending longitudinally along the rail 28.

To engage with such a rail as shown in FIG. 7, the opposite end corners of the mutually respective ends of the slats 16 have notches cut in the lateral side surface of the slats 16. The notches are not shown in the cross-sectional view of FIG. 8, but are similar to the notches 44 of the slat 16 shown in FIG. 5 Also similar to the slat 16 of FIG. 5, the end of the slat 16 of FIG. 7 comprises a pair of substantially planar, resilient, spaced flange members 46 which are shown in FIG. 7 at the bottom end of the slat 16. The flange members 46 are similar to the flange members 46 of the slat 16 shown in FIG. 5.

The engagement members on the slat 16 of FIG. 7 are formed by an integral barbs 42 extending inwardly of the slat 16 from at least one of said spaced flange members 46. As shown in FIG. 7 barbs 42 preferably extend inwardly from both sides of the slat 16, i.e., from both of the flange members 46 at the bottom of the slat 16. The spaced flange members 46 of mutually respective slats 16 are adapted to be inserted over said elongate rail 28, with the barbs 42 on the respective flange members 46 making interlocking engagement with the elongate fins 52 of the elongate rail 28 as shown in FIG. 7.

Figure 9:
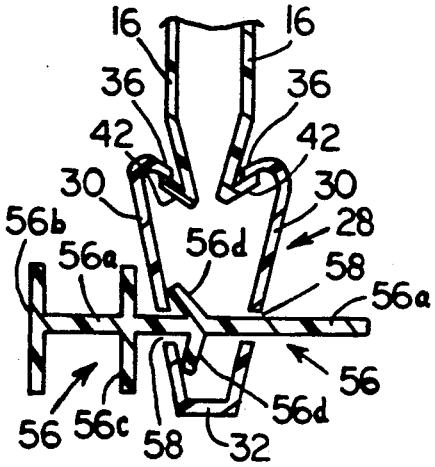
FIG. 9 is a cross section similar to one taken along line 2—2 of FIG. 1 but showing a novel clip means for locking the rail within the chain link fabric of the fence.
Figure 10:
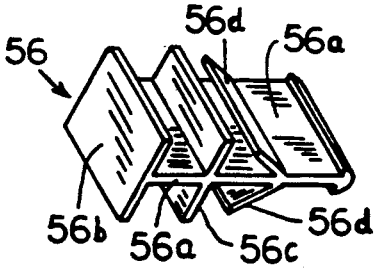
FIG. 10 is a pictorial view of the clip member shown in FIG. 9.
Figure 4:
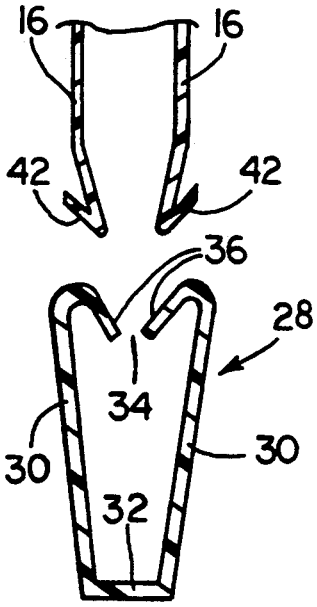
FIG. 4 is an exploded cross section similar to that of FIG. 2 but showing an alternative embodiment of a rail and mutually corresponding end of a slat in accordance with the invention.
Figure 11:
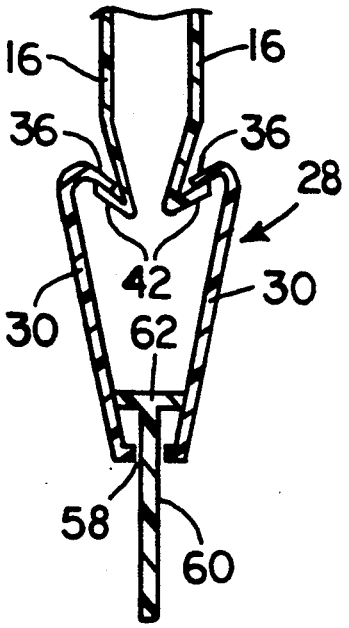
FIG. 11 is a cross section similar to that of FIG. 9 but showing an alternative embodiment of novel clip means for locking the rail within the chain link fabric of the fence.

In preferred embodiments illustrated in FIGS. 9, 10 and 11, there are means provided for locking the elongate rail 28 itself in position in the chain link fence. In such embodiments, at least one receptacle is formed in each of the elongate rails 28. An elongate lock member engages the receptacle, with the elongate lock member being supported entirely by the rail 28. The elongate lock member extends from at least one side of said rail such that the elongate lock member forms a lock pin which obstructs the chain link fencing if the rail 28 containing the elongate lock member is moved in a direction of the longitudinal axis of the rail 28. Thus, the rails 28 are locked into the chain link fencing.

A particular locking member for retaining and locking the rail 28 in the fencing is shown in FIG. 9 and 10. The locking member comprises an elongate clip 56 which engages mutually respective receptacles 58 in the rails 28. The clip 56 extends from at least one side of the rail 28 so that the clip 56 forms a lock pin which sticks out and creates an obstruction with the links 10 in the chain link fencing whenever the rail 28 is moved in a direction of its longitudinal axis.

A particularly advantageous shape of the clip 56 is shown in FIG. 10. The clip 56 comprises an elongate, thin, substantially planar sheet **56*a*. The width of the sheet 56*a* is such as to fit snugly within the corresponding openings or receptacles 58 in the rails 28. A flat end portion 56*b* forms the head end of the clip 56. The flat end portion 56*b* is substantially planar and is attached to the end of the flat sheet 56*a* so as to be substantially perpendicular thereto. The flat end portion 56*b* forms the head of the clip 56 as illustrated in FIG. 10. Two substantially planar ledges 56*c* project from the sheet 56*a*, with the ledges 56*c* preferably being in the same plane so as to project from opposite faces of the sheet 56*a*. The ledges 56*c* are preferably in a plane which is perpendicular to the sheet 56*a*. Barbs 56*d* extend from the sheet 56*a*, with the barbs being spaced from the ledges 56*c*. The barbs 56*d* are advantageously formed by elongate flat extensions which are in planes which form an acute angle to the sheet 56*a*. The flat extensions forming the barbs 56*d* must of course slope toward the head end of the clip 56** to function in the well known action of a barb.

The barbs **56*d* and the flat ledges 56*c* of the clip 56 form together interlocking means which engage the respective receptacles 58 in the rails 28 to interlock the clip 56 in the rail 28. As can be seen best in FIG. 9, the barbs 56*d* slide in the opening or receptacle 58 on one side of the rail 28, and once inside the space in the rail 28, the barbs 56*d* expand and form an obstruction which prevents the clip 56 from being withdrawn back through the opening. The flat ledges 56*c* form an obstruction which will not allow the clip 56 to move further into the opening or receptacle 58. Thus, the clip 56 is securely locked in place in the rail 28**.

A somewhat more simple means of locking the rail in the chain link fence is shown in FIG. 11. The receptacle 58 is formed in the base 32 of the rail 28, and an elongate pin 60, which can be shaped like a nail, is inserted from the inside of the rail through the receptacle 58. The pin 60 extends sufficiently to obstruct a link 10 in the fence if the rail 28 is attempted to be moved in a direction along its longitudinal axis. The head 62 of the pin 60 prevents the pin 60 from passing completely through the receptacle 58, and when slats 16 are engaged in the rail, the slats 16 prevent the pin 60 from being removed or retracted from the rail 28. Thus, the pin 60 is securely locked in place in the rail 28.

Figure 16:
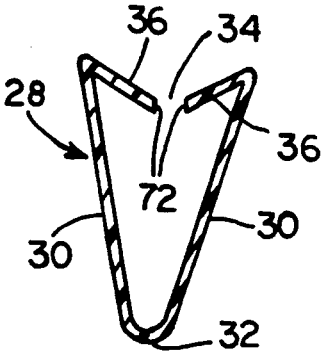
FIG. 16 is an end elevation of the rail of FIGS. 12 and 13.

A particularly preferred embodiment of an inexpensive, easily manufactured slat 16 and interlocking rail 28 is shown in FIGS. 12–17. The rail 28 is basically as described hereinbefore, with two sides 30 which extend from an elongate base 32 to form the general shape of a trough in which the margins of the sides 30 lie adjacent to each other to form an elongate opening therebetween. Elongate, engageable lips 32 project inwardly from the margin of at least one of the sides 30 of the rail 28 toward the central portion of the rail 28. Preferably, the lip 30 slants so as to form an acute angle of between about 25 and 70 degrees with the respective side 30 of the rail 28, and the free lateral edge 72 of the lip 36, as shown in FIG. 16, has a substantially sharp knife-edge pointing toward the base 32 of the rail 28.

The embodiment of the slat 16, as illustrated in FIGS. 12–15, is similar to that described previously, having broad, elongate sides 18 which are spaced apart by a pair of curved lateral edges 22 that join the opposite sides 18 together to form a substantially hollow, flattened, tubular shape. A planar slit 70 is cut by a sharp edged instrument in each of the slats 16 closely adjacent to the end thereof. The slit 70 is cut through one of the broad sides 30 and extends into the lateral edges of the slat 16 by a distance of at least about the wall thickness of the lateral edges 22 of the slat 16 and no greater than all the way through the curved lateral edges 22. The slit 70 is inclined such that the plane of the slit slants inwardly from the one side 30 of the slat 16 toward the adjacent end of the slat 16. The plane of the slit 70 preferably slants so as to form an acute angle of between about 25 and 70 degrees with the respective side 18 of the slat 16. Preferably, the slit 70 extends about one fourth and no greater than about three fourths of the way through the curved lateral sides 22 of the slat 16, and in a most preferred embodiment, the slit 70 extends about one half way through the curved lateral sides 22 of the slat 16.

Figure 12:
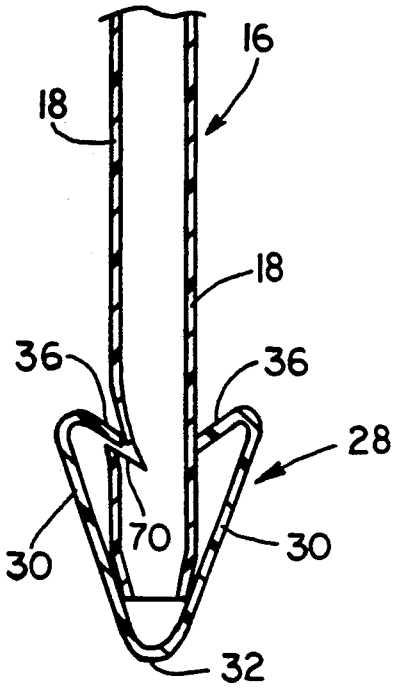
FIG. 12 is a cross section similar to one taken along line 2—2 of FIG. 1 but showing a fifth preferred embodiment of the rail and slat in accordance with the invention.
Figure 13:
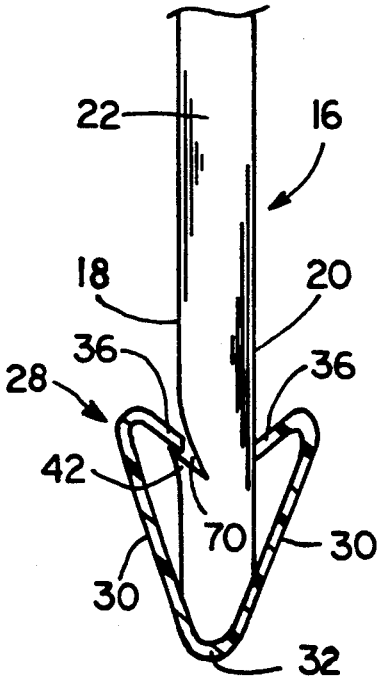
FIG. 13 is a view similar to that of FIG. 12 but showing the side elevation of the slat rather than a cross section thereof.

As illustrated in FIGS. 12 and 13, when the end of the slat 16 is inserted in the opening 72 between the lips 36 and sides 30 of the rail 28, one of the lips 36 interlocks and engages with the slit 70 in the slat 16 to retain the end of the slat 16 within the opening or trough of the rail 28. As can be seen from the drawings, the slit 70 is spaced from the end of the slat 16 such that the end of the slat tends to engage the sloped sides of the rail when the lips 36 engage the slit 70. Depending upon the size of the rail 28, the portion of the slit 70 cutting through one of the sides 18 of the slat 16 will generally by spaced from the end of the slat by between about one fourth inch and one inch.

Figure 15:
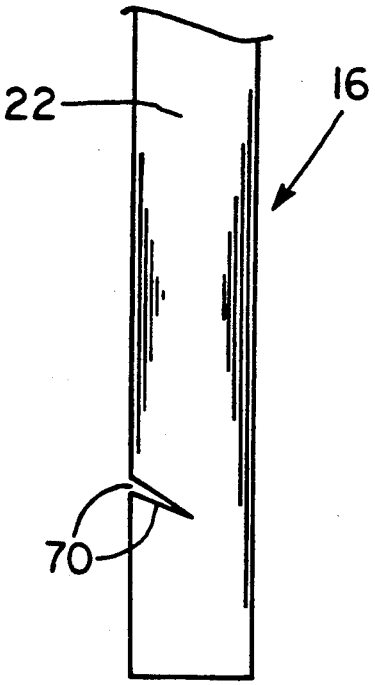
FIG. 15 is a side elevation of the end of the slat of FIG. 14.

It has been found that the slit 70 is a highly desirable embodiment of means for engaging the slat 16 with the rail 28. The slit 70 does not deform the profile of the slat 16 to any substantial degree. As shown in FIG. 14 and 15, the profile of the side and edges of the slat 16 into which the slit 70 is cut remains substantially continuous, with an essentially smooth surface shape. Thus, when the slats 16 are bound together for storage and shipment, there is no projection on the side of the slats which can be pushed back into the slat so as to require repositioning prior to installation of the slats in a fence. Slats embodying the slit 70 can be bundled so as to be pressed very tightly together during storage and shipment, with the slats requiring no further preparation or checking when being installed in a chain link fence.

It has further been found that the slats embodying the slits 70 make exceptionally good engagement with the lip 36 of the rail 28. When the ends of the slats 16 are inserted into the rail 28, the sides 30 and opposing lips 36 are forced apart, and the lips 36 apply pressure to the opposite, broad surfaces of the slats 16. As best shown in FIGS. 12 and 13, the pressure of the lip 36 positioned immediately above the slit 70 tends to compress the side 30 of the slat 16 inwardly so as to expose the lower edge of the slit 70. The knife-edge point of the lip 36 then makes positive engagement with the slit 70. Any force in the slats 16 tending to withdraw them from the rail 28 acts to further embed the knife-edge of the lip 36 into the slit 70. Thus, the slats 16 are effectively interlocked with the rail 28.

It can be seen that the depth of penetration of the slits 70 into the side edges 22 of the slats 16 need only be sufficient for the knife-edges of the lips 36 of the rails 28 to engage the slits 70. As stated previously, the slits 70 must extend into the side edges 22 of the slats 16 by a distance equal to at least the wall thickness of the lateral edges 22 of the slats 16 so that the knife-edges of the lips 36 can make positive engagement. Preferably, the slits 70 extend more deeply into the side edges 22 as explained previously. This allows more compression of the side of the slats 16 by the pressure of the lips 36 and expedites engagement of the slits 70 by the knife-edges of the lips 36.

It should also be noted here that the links 10 of the fencing fabric engage the outer surfaces of the sides 30 of the rail 28 to add support to the sides 30 of the rail. This support augments the pressure applied by the lips 36 to the ends of the slats 16 which are inserted between the lips 36 of the rail 28. Further, by spacing the slits 70 at a proper distance from the ends of the slats 16, the ends of the slats will engage the converging inner surfaces of the sides 30 of the rails 28. The ends of the broad sides 30 of the slats 16 will thus be compressed which tends to push the adjacent edge of the slits 70 outwardly to more readily engage the knife-edges of the lips 36 of the rail 28.

Figure 17:
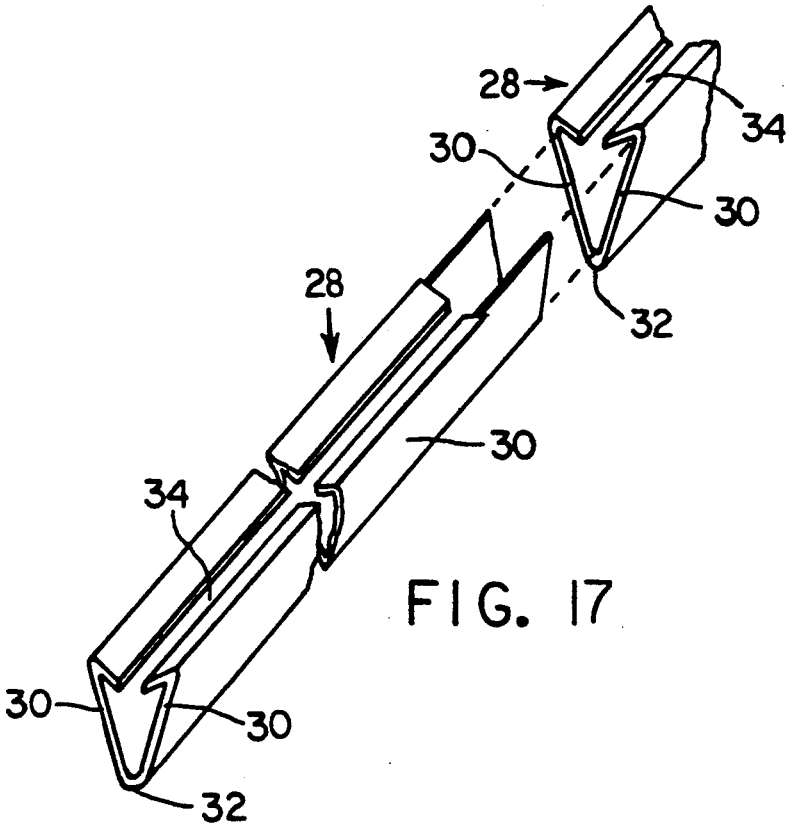
FIG. 17 is a pictorial of a preferred embodiment of rail formed from segments which are adapted to be telescopically engaged in end-to-end alignment.

A particularly preferred embodiment of the rail 28 is shown in FIG. 17. The rail comprises elongate segments having first and second ends The segments are arranged in end-to-end relationship so that the first ends of the segments meet respective second ends of adjacent segments The elongate lips 36 of the rail segments extend from the first ends of the segments to within a relatively short distance, such as from one half inch to one or two inches from the second ends of the segments, such that the second ends of the segments can be telescopically engaged with corresponding first ends of adjacent segments. As shown in FIG. 17, the margin of the sides 30 of the rail at the second end are advantageously notched downwardly so as to facilitate the telescopic engagement of the first end of an adjacent rail segment. The notched second ends of the rail segments are inserted into the first ends of adjacent rail segments such that the segments form a rigid elongate member, with the lips 36 being continuous along the length of the elongate member.

It is to be understood that the present disclosure, including the detailed description of preferred embodiments, is made by way of example and that various other embodiments are possible without departing from the subject matter coming within the scope of the following claims, which subject matter is regarded as the invention.

I claim:

1. In chain link fencing of the type including a plurality of elongate slats which have first and second longitudinal ends, with each slot being characterized by a pair of broad, elongate sides which are spaced apart by a pair of curved lateral edges that join the opposite sides together to form a substantially hollow, flattened, tubular shape, wherein said slats are woven flatwise through the links of the chain link fabric of the fencing in spaced, parallel arrangement, an improvement in means for retaining and locking the slats within the fencing, said improvement comprising an elongate rail woven between consecutive links of the chain link fence such that the rail lies adjacent to mutually respective aligned, first ends of said elongate slats, said rail having two sides which extend from an elongate base to form the general shape of a trough, with the extending margins of the sides of said rail lying adjacent to each other to form an elongate opening therebetween;

an elongate, engageable lip projecting inwardly from the margin of at least one of the side of said rail toward the central portion of said elongate rail, wherein said elongate lip slants so as to form an acute angle of between about 25 to 70 degrees with the respective side of said elongate rail, and the free lateral edge of said lip has a sharp knife edge pointing toward the base of said rail; and a planar slit cut in each of said slats closely adjacent to the first end thereof, said slit being cut through one of the broad sides and extending into the lateral edges of said slat by a distance of at least about the wall thickness of the lateral edges of said slat and no greater than all the way through said curved lateral edges of said slats, said slit being inclined such that the plane of said slit slants inwardly from said one of the broad sides of said slat toward said first end of said slat, whereby when a mutually respective first end of a slat is inserted in the opening between the sides of said elongate rail, the knife edge on the elongate lip on said rail interlocks and engages with the slit in said slat to retain the first end of said slat within said opening in said elongate rail.

2. The improvement in chain link fencing in accordance with claim 1, wherein said slit extends at least about one fourth and no greater than about three fourths of the way through said curved lateral edges of said slats.

3. The improvement in chain link fencing in accordance with claim 1, wherein the rail comprises elongate segments having first and second ends, with said segments being laid end-to-end so that the first ends of said segments meet respective second ends of adjacent segments, and further wherein the elongate lips on the rail segments extend from the first ends of the segments to within a relatively short distance of the second ends thereof such that the second ends of said segments can be telescopically engaged with corresponding first ends of adjacent segments.

4. An elongate slat of the type which is woven through the links of chain link fencing, said slats being characterized by a pair of broad, elongate sides which are spaced apart by a pair of curved lateral edges that join the opposite sides together to form a substantially hollow, flattened, tubular shape; and a planar slit cut through one of the broad sides of said slat and extending into the lateral edges of said slat by a distance of at least about the wall thickness of the lateral edges of said slat and no greater than all the way through said curved lateral edges of said slat, with said slit being inclined such that the plane of said slit slants inwardly from said one of the broad sides of said slat toward one of the ends of said slat.

5. A slat in accordance with claim 4, wherein said slit extends at least about one fourth and no greater than about three fourths of the way through said curved lateral edges of said slat.

6. A rail of the type which is woven through the links of chain link fencing, said rail having first and second ends and further being characterized by two sides which extend from an elongate base to form the general shape of a trough, with the extending margins of the sides of said rail lying adjacent to each other to form an elongate opening therebetween; and an elongate, engageable lip projecting inwardly from the margin of at least one of the sides of said rail toward the central portion of said rail, with the elongate lip extending continuously from the first end of said rail to within a relatively short distance of the second end of said rail.

7. In chain link fencing of the type including a plurality of elongate slats which have hollow, flattened, tubular shapes and which are woven flatwise through the links of the chain link fabric of the fencing in spaced, parallel arrangement, an improvement in means for retaining and locking the slats within the fencing, said improvement comprising an elongate rail woven between consecutive links of the chain link fence such that the rail lies adjacent to mutually respective, aligned, first ends of said elongate slats, said elongate rail having two sides which extend from a base to form the general shape of a trough, with the extending margins of said sides lying adjacent to each other to form an elongate opening therebetween;

an elongate, engageable lip projecting inwardly from the margin of at least one of the sides of said rail toward the central portion of said rail; and engagement means associated with the mutually respective first ends of said elongate slats for making interlocking engagement with said elongate rail, wherein said engagement means comprises notches cut in the lateral side surface of said slats at the opposite end corners of the mutually respective first ends of said slats such that each of the mutually respective first ends of said slats includes a pair of substantially planar, resilient, spaced flange members;

a barb extending outwardly from at least one of the spaced flange members, whereby the spaced flange members of mutually respective first slats are adapted to be inserted into said elongate opening of said elongate rail, with the barbs on the respective flange members making interlocking engagement with said elongate lip of said elongate rail.

8. The improvement in chain link fencing in accordance with claim 7, wherein each of said sides of said elongate rail has a lip projecting inwardly therefrom; and each of said spaced flange members of said slats have a barb extending outwardly therefrom.

9. The improvement in chain link fencing in accordance with claim 7, wherein said barb is formed on said flange member by a ledge extending outwardly of said flange member in a direction away from the otherwise free end of said flange member.

10. In chain link fencing of the type including a plurality of elongate slats which have hollow, flattened, tubular shapes comprising opposite, spaced broad sides and opposite, lateral, curved edges, with said slats being woven flatwise through the links of the chain link fabric of the fencing in spaced, parallel arrangement, an improvement in means for retaining and locking the slats within the fencing, said improvement comprising an elongate rail woven between consecutive links of the chain link fence such that the rail lies adjacent to mutually respective, aligned, first ends of said elongate slats, said elongate rail having two sides which extend from a base to form the general shape of a trough, with the extending margins of said sides lying adjacent to each other to form an elongate opening therebetween;

an elongate, engageable lip projecting inwardly from the margin of at least one of the sides of said rail toward the central portion of said rail; and engagement means associated with the mutually respective first ends of said elongate slats for making interlocking engagement with said elongate rail, wherein said engagement means comprises a first barb formed at each of the mutually respective first ends of the elongate slats by punching a flat, first projection from one flat side of the slat adjacent to the first end thereof, with said first projection slanting outwardly of said slat in a direction away from the first end of said slat; and a second barb is formed at each of the mutually respective first ends of the elongate slats by punching a flat, second projection from the flat side of the slat opposite the flat side from which said first projection is punched, with said second projection slanting in the same direction as said first projection such that the outer end of said second projection extends across the width of said slat and lies adjacent to said first projection, whereby when a mutually respective first end of a slat is inserted in the opening between the sides of said elongate rail, the first barb interlocks and engages with said lip to retain the first end of said slat within said opening in said elongate rail.

11. The improvement in chain link fencing in accordance with claim 10, wherein the second projection is slightly larger in width than said first projection, such that said second projection is forced into an opening formed in said slat by the punching of said first projection, whereby said outer end of said second projection is bound in position lying adjacent to said first projection.

12. In chain link fencing of the type including a plurality of elongate slats which have hollow, flattened, tubular shapes and which are woven flatwise through the links of the chain link fabric of the fencing in spaced, parallel arrangement, an improvement in means for retaining and locking the slats within the fencing, said improvement comprising an elongate rail woven between consecutive links of the chain link fence such that the rail lies adjacent to mutually respective, aligned, first ends of said elongate slats, said elongate rail having a substantially triangular cross-sectional shape in which two legs of the triangular, cross-sectional shape extend from the opposite sides of the third leg of the triangular, cross-sectional shape to meet in a point which faces the mutually respective slats, and the intersection of said two legs and the third leg form elongate, engageable edges extending longitudinally along said rail;

notches cut in the lateral side surfaces of said slats at the opposite end corners of the mutually respective first ends of said slats such that each of the mutually respective first ends of said slats includes a pair of substantially planar, resilient, spaced flange members; and an integral barb extending inwardly of each of said slats from at least one of said spaced flange members;

whereby the spaced flange members of mutually respective slats are adapted to be inserted over said elongate rail, with the barbs on the respective flange members making interlocking engagement with said elongate engageable edges of said elongate rail.

13. The improvement in chain link fencing in accordance with claim 12, wherein each of said spaced flange members has a barb extending inwardly therefrom.

14. In chain link fencing of the type including a plurality of elongate slats which have hollow, flattened, tubular shapes and which are woven flatwise through the links of the chain link fabric of the fencing in spaced, parallel arrangement, an improvement in means for retaining and locking the slats within the fencing, said improvement comprising an elongate rail woven between consecutive links of the chain link fence such that the rail lies adjacent to mutually respective, aligned, first ends of said elongate slats, said elongate rail having a substantially triangular cross-sectional shape in which two legs of the triangular, cross-sectional shape extend from the opposite sides of the third leg of the triangular, cross-sectional shape to meet in a point which faces the mutually respective slats;

an elongate fin projects outwardly from at least one of said two legs of the triangular, cross-sectional shape of said rail to form an engageable edge extending longitudinally along said rail;

the opposite end corners of the mutually respective first ends of said slats have notches cut in the lateral side surface of said slats such that each of the mutually respective first ends of said slats comprises a pair of substantially planar, resilient, spaced flange members; and the engagement members are formed by an integral barb extending inwardly of the mutually respective slat from at least one of said spaced flange members of each slat;

whereby the spaced flange members of mutually respective slats are adapted to be inserted over said elongate rail, with the barbs on the respective flange members making interlocking engagement with said elongate fins of said elongate rail.

15. The improvement in chain link fencing in accordance with claim 14, wherein a mutually respective fin projects outwardly from both of said two legs of the triangular, cross-sectional shape of said rail; and each of said spaced flange members of each of said slats has a barb extending inwardly of the mutually respective slat.

16. In chain link fencing of the type including a plurality of elongate slats which have hollow, flattened, tubular shapes and which are woven flatwise through the links of the chain link fabric of the fencing in spaced, parallel arrangement, an improvement in means for retaining and locking the slats within the fencing, said improvement comprising an elongate rail woven between consecutive links of the chain link fence such that the rail lies adjacent to mutually respective, aligned, first ends of said elongate slats;

engagement means associated with the mutually respective first ends of said elongate slats for making interlocking engagement with said elongate rail;

at least one receptacle formed in each of said elongate rails;

an elongate member engaging each receptacle, said elongate member being supported entirely by said rail, with the elongate member extending from at least one side of said rail such that the elongate member forms a lock pin which obstructs the chain link fencing if said rail containing said elongate member is moved in a direction of the longitudinal axis of said rail, whereby said rails are locked into the chain link fencing.

17. The improvement in chain link fencing in accordance with claim 16, wherein interlocking means are provided on each elongate member, said interlocking means engaging with the respective receptacle in said rail to connect said elongate member to said rail.

18. The improvement in chain link fencing in accordance with claim 17, wherein said interlocking means comprises a barb on each of said elongate members.

* * * * *